US007980677B2

(12) United States Patent
Chino et al.

(10) Patent No.: US 7,980,677 B2
(45) Date of Patent: Jul. 19, 2011

(54) INK JET RECORDING HEAD

(75) Inventors: Noriyuki Chino, Kawasaki (JP); Shoji Kanemura, Sagamihara (JP); Hiroyasu Nomura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 12/240,371

(22) Filed: Sep. 29, 2008

(65) Prior Publication Data

US 2009/0096838 A1 Apr. 16, 2009

(30) Foreign Application Priority Data

Oct. 3, 2007 (JP) ..... 2007-259901

(51) Int. Cl.
*B41J 2/05* (2006.01)

(52) U.S. Cl. ..... 347/65; 347/42; 347/56; 347/61; 347/85; 347/92

(58) Field of Classification Search ..... 347/42, 347/56, 61, 65, 85, 92
See application file for complete search history.

(56) References Cited

U.S. PATENT DOCUMENTS 5,402,160 A 3/1995 Kadowaki et al.
5,451,989 A 9/1995 Kadowaki et al.
5,900,894 A * 5/1999 Koizumi et al. ..... 347/65
6,109,734 A * 8/2000 Kashino et al. ..... 347/65
6,305,790 B1 * 10/2001 Kawamura et al. ..... 347/65
6,540,327 B1 * 4/2003 Akiyama et al. ..... 347/43
7,201,476 B2 * 4/2007 Buchanan et al. ..... 347/87
7,815,297 B2 * 10/2010 Kotaki et al. ..... 347/86
2005/0157091 A1 * 7/2005 Hu et al. ..... 347/65

* cited by examiner

*Primary Examiner* — Ryan Lepisto

(74) *Attorney, Agent, or Firm* — Fitzpatrick, Cella, Harper & Scinto

(57) ABSTRACT

An ink jet recording head includes recording element substrates each including at least one nozzle array and heat generating resistors, a common liquid chamber having introducing and discharging ports, and a supporting member mounting the recording element substrates and in which a plurality of individual liquid chambers for supplying the ink to respective recording element substrates and a plurality of ink inlet ports for supplying the ink from the common liquid chamber to respective individual liquid chambers are formed. The individual liquid chambers are arranged in a direction of flow of the ink from the ink introducing port toward the discharging port. At least in a most upstream individual liquid chamber with respect to the direction, a center line of an associated inlet port with respect to the direction is located downstream of a center line of the upstream individual liquid chamber with respect to the direction.

7 Claims, 8 Drawing Sheets

INK JET RECORDING HEAD

FIELD OF THE INVENTION AND RELATED ART

The present invention relates to an ink jet recording apparatus and a control method of the ink jet recording apparatus and particularly relates to an ink jet recording head for ejecting ink by utilizing thermal energy generated from a thermal energy transducer. More specifically, the present invention relates to a recording head structure for suppressing a difference in temperature, between a plurality of recording element substrates, of ink to be supplied to the plurality of recording element substrates mounted in a full-line type recording head.

In ink jet recording apparatus of one type, a plurality of recording heads each including a plurality of recording elements fixed in parallel with each other is provided, and a recording medium is scanned with the recording heads to effect recording. The ink jet recording apparatus of this type is characterized by a recording speed higher than that of a so-called serial scanning type ink jet recording apparatus in which recording is effected by performing scanning with a recording head.

The ink jet recording apparatus effects image recording such as printing by ejecting ink from a recording head to be attached onto a recording medium. The ink jet recording apparatus facilitates downsizing of the recording head and can record a high-definition image at high speed. Further, the ink jet recording apparatus provides a low running cost and is of a non-impact type, thus resulting in less noise. In addition, the ink jet recording apparatus has the advantage of, e.g., easily recording a color image by using multi-color ink. Of the above-described ink jet recording apparatus, the full-line type ink jet recording apparatus using a line type recording head including a multiplicity of ejection nozzles arranged in a width direction of the recording medium can further increase in recording speed.

An embodiment of a recording head used in the full-line type ink jet recording apparatus is shown in FIG. 7 including a schematic sectional view and a bottom view.

First, referring to FIG. 7, a schematic structure of the recording head will be described. Nine recording element substrates 201*a* to 201*i* each including four arrays of heat generating resistors for ejecting ink by thermal energy and four nozzle arrays, are mounted on one side surface of a supporting member 202 in a staggered fashion. On an opposite side surface of the supporting member 202, a container chip 203, in which a common liquid chamber 205 for retaining ink in a negative pressure state is formed, is hermetically fixed so as not to cause ink leakage.

Next, a regular route of ink supply to each of the recording element substrates will be described. Ink introduced from an ink introducing port 206 into the recording head successively enters respective individual liquid chambers 204*a* to 204*e* formed in the supporting member 202 while flowing in the common liquid chamber 205 in a longitudinal direction of the recording head. The ink flowing into the individual liquid chambers 204*a* to 204*e* is supplied to each of nozzle arrays of odd-numbered array of recording element substrates 201*a* to 201*e* and each of nozzle arrays of even-numbered array of recording element substrates 201*f* to 201*i*. Bubbles generated in the recording element substrates 201*a* to 201*e* are moved upward in the individual liquid chambers 204*a* to 204*e* by buoyancy and are collected at an upper portion of the common liquid chamber 205. These bubbles are considered to include remaining bubbles generated by ejecting ink through actuation of the heat generating resistors, bubbles generated from air dissolved in the ink, and bubbles entering the individual liquid chambers through constituent members of the recording head. The bubbles collected at the upper portion of the common liquid chamber 205 are discharged from a discharging port 207 for bubble removal together with the ink by circulation of the ink flowing from the ink introducing port 206 toward the discharging port 207, thus being collected by an unshown ink container. The individual liquid chambers 204*a* to 204*e* are formed in such a shape that the ink can be supplied smoothly and the bubble removal is not adversely affected.

Next, a conveying process of the recording medium and a recording process on the recording medium will be described. Referring to the bottom view of FIG. 7, the recording medium is conveyed from an up-to-down direction in parallel with one side surface of the supporting member 202 in a direction perpendicular to an arrangement direction of the nozzle arrays of the recording element substrates 201*a* to 201*e* by an unshown conveying means. When the recording medium reaches a position immediately below the recording head, first, ink droplets are ejected from each of nozzle arrays of the odd-numbered recording element substrates 201*a* to 201*e* to form dots on the recording medium. Then, ink droplets are ejected from each of nozzle arrays of the even-numbered recording element substrates 201*f* to 201*i* to form dots on the recording medium so as to complement intervals among the dots previously formed, thus completing an image for each raster.

With higher-speed recording, the number of ejections of ink from one nozzle per unit time is increased, thus increasing electric energy consumption. As a result, an increase in amount of heat generation of the recording element substrates 201*a* to 201*i* is caused to occur. The increased amount of heat is principally conducted from the recording element substrates 201*a* to 201*i* to the supporting member 202 except for heat dissipated into an outside of the recording head together with the ejected ink. The heat conducted to the supporting member 202 is absorbed by ink flowing in the common liquid chamber 205 on the opposite side surface of the supporting member 202. When an amount of heat absorption of the ink in the common liquid chamber 205 is increased, a temperature of the ink in the common liquid chamber 205 is higher at a downstream position more distant from the ink introducing port 206. For this reason, in a more downstream recording element substrate, heat is less conducted to the supporting member, so that an amount of temperature rise is increased. Further, in the more downstream recording element substrate, the ink higher in temperature is supplied through the individual liquid chamber 204.

That is, heat of an upstream recording element substrate is transmitted to the downstream recording element substrate by the medium of the ink flowing in the common liquid chamber 205. For this reason, thermal imbalance such that a more downstream recording element substrate is liable to be higher in temperature occurs and is more noticeable with higher-speed recording leading to increase the amount of heat generation, so that a difference in temperature between the recording element substrates is increased.

FIG. 8 is a graph showing a temperature distribution of the recording head as a specific result of study.

An abscissa of the graph represents a distance corresponding to a position of the recording head with respect to a longitudinal direction of the recording head, and an ordinate of the graph represents temperatures of recording element substrates. At both end portions of each recording element substrate, temperature sensors 230*a* and 230*b* are provided so as to permit measurement of temperature at the both end portions. A plot of the temperatures from these temperature sensors is the graph shown in FIG. 8 and a line segment 210*a* represents a temperature gradient of the recording element substrate 201*a*.

As seen from this graph, during temperature rise, a temperature distribution of the recording head with respect to the longitudinal direction is such that a temperature at a central portion is higher and a temperature at an end portion is lower. Further, with respect to the recording element substrate on an ink introducing side, it is possible to confirm that a large temperature gradient occurs between left and right ends.

As described above, when the temperature difference between the recording element substrates is increased, a difference in ejection amount, i.e., a difference in density is also increased, thus adversely affecting a recording quality.

Therefore, in order to realize the high-speed recording while retaining the recording quality in the full-line type ink jet recording apparatus, there arises a problem to be solved such that the temperature difference between the recording element substrates is suppressed. In order to solve this problem, there have been conventionally proposed constitutions such that an end of a heat pipe is connected along a recording head as a heat uniformizing means (U.S. Patent Nos. 5,402,160 and 5,451,989). In these heat uniformizing means for the conventional full-line type ink jet recording head, the heat pipe absorbs local heat of the recording head generated by ejection of ink and quickly diffuses the local heat through the entire recording head, so that it is possible to keep the entire recording head at a temperature as uniform as possible by suppressing the local temperature rise of the recording head.

However, in the case of using the heat pipe, additional cost is incurred and a connecting operation of the heat pipe to the recording head requires skills. Therefore, a production cost is further increased, thus leading to an expensive recording head.

Further, in the case of incorporating the heat pipe into the full-line type ink jet recording head shown in FIG. 7, the heat pipe had to be incorporated between or at both sides of the odd-numbered array of the recording element substrates and the even-numbered array of the recording element substrates so as to avoid individual ink supply passages 4. For this reason, the recording head was increased in length in a width direction, so that there arose a problem such that it is difficult to adjust registration between the odd-numbered and even-numbered arrays of the recording element substrates and registration between a plurality of recording heads arranged in the width direction.

SUMMARY OF THE INVENTION

A principal object of the present invention is to provide an ink jet recording head capable of suppressing an increase in temperature gradient in recording element substrate and increases in differences in temperature and density between recording element substrates with a simple constitution and no unnecessary increase in width of the recording head.

According to an aspect of the present invention, there is provided an ink jet recording head comprising:

a plurality of recording element substrates each including at least one nozzle array having a plurality of nozzles for ejecting ink and heat generating resistors for ejecting the ink by thermal energy;

a common liquid chamber having an ink introducing port for supplying the ink to the nozzles and a discharging port for discharging the introduced ink outside the ink jet recording head; and a supporting member on which the recording element substrates are mounted and in which a plurality of individual liquid chambers for supplying the ink to associated ones of the recording element substrates and a plurality of ink inlet ports for supplying the ink from the common liquid chamber to associated ones of the individual liquid chambers are formed, wherein the individual liquid chambers are arranged in a direction of flow of the ink flowing from the ink introducing port toward the discharging port, and wherein at least in an upstreammost individual liquid chamber with respect to the direction, an ink flow passage length from an associated ink inlet port to a nozzle located upstream with respect to the direction is longer than an ink flow passage length from the associated ink inlet port to a nozzle located downstream with respect to the direction.

According to the present invention, it is possible to suppress an increase in temperature gradient in recording element substrate and increases in differences in temperature and density between recording element substrates with a simple constitution and no unnecessary increase in width of the recording head.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Herein, an "upstream side" refers to a side on which ink is supplied to an ink jet recording head and a "downstream side" refers to a side on which a bubble is discharged from the ink jet recording head through a discharging port.

First Embodiment

In the following embodiments, as an example of a recording apparatus using an ink jet recording method, a printer will be described.

Herein, "recording" (also referred to as "print") represents not only formation of significant information such as a character or graphics but also formation of an image, a pattern, or the like on a recording medium, irrespective of significance or insignificance or processing of a medium.

The recording medium refers to not only paper used in a general recording apparatus but also various ink-receivable materials such as clothes, plastics, metal plates, ceramics, woods, and leathers.

The ink (also referred to as a "liquid") is widely interpreted similarly as in the definition of the recording (print). That is, the "ink" represents a liquid subjected to formation of an image, a pattern, or the like, processing of a recording medium, or processing of ink (e.g., coagulation or insolubilization of a colorant in ink to be provided onto the recording medium) by being provided onto the recording medium.

Figure 1:
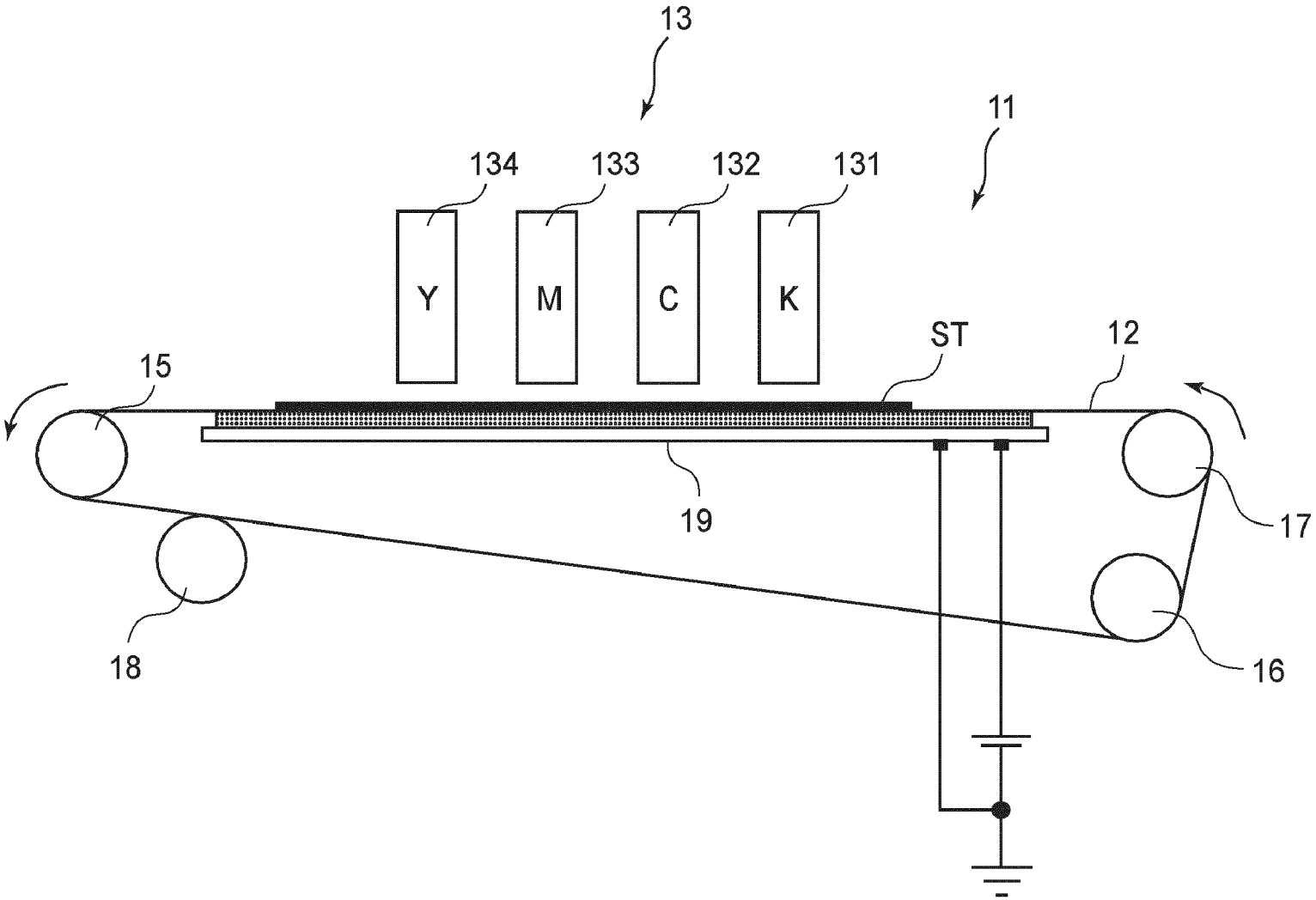
FIG. 1 is a sectional view showing a schematic structure of an ink jet recording head as an embodiment of the present invention.

FIG. 1 is a sectional view showing a schematic structure of an ink jet recording apparatus 11 as an embodiment of the present invention.

In this embodiment, a recording head 13 includes four recording heads 131 to 134 for ejecting inks of black (K), cyan (C), magenta (M) and yellow (Y). These recording heads 131 to 134 are driven by a control portion described later and eject ink droplets of associated ones of the inks to effect color recording.

A sheet-like recording medium (hereinafter referred to as a "recording sheet") ST is fed from an unshown sheet feeding portion and is electrostatically adsorbed by a conveyer belt 12 to be moved below the recording head 13. At this time, recording is effected. The conveyer belt 12 as a conveying device is an annular elongated member and is stretched by a driving roller 15 and supporting rollers 16 and 17. The conveyer belt 12 is rotationally driven to convey the recording sheet ST. A cleaning mechanism 18 is used to remove ink deposited on the conveyer belt 12.

Figure 2:
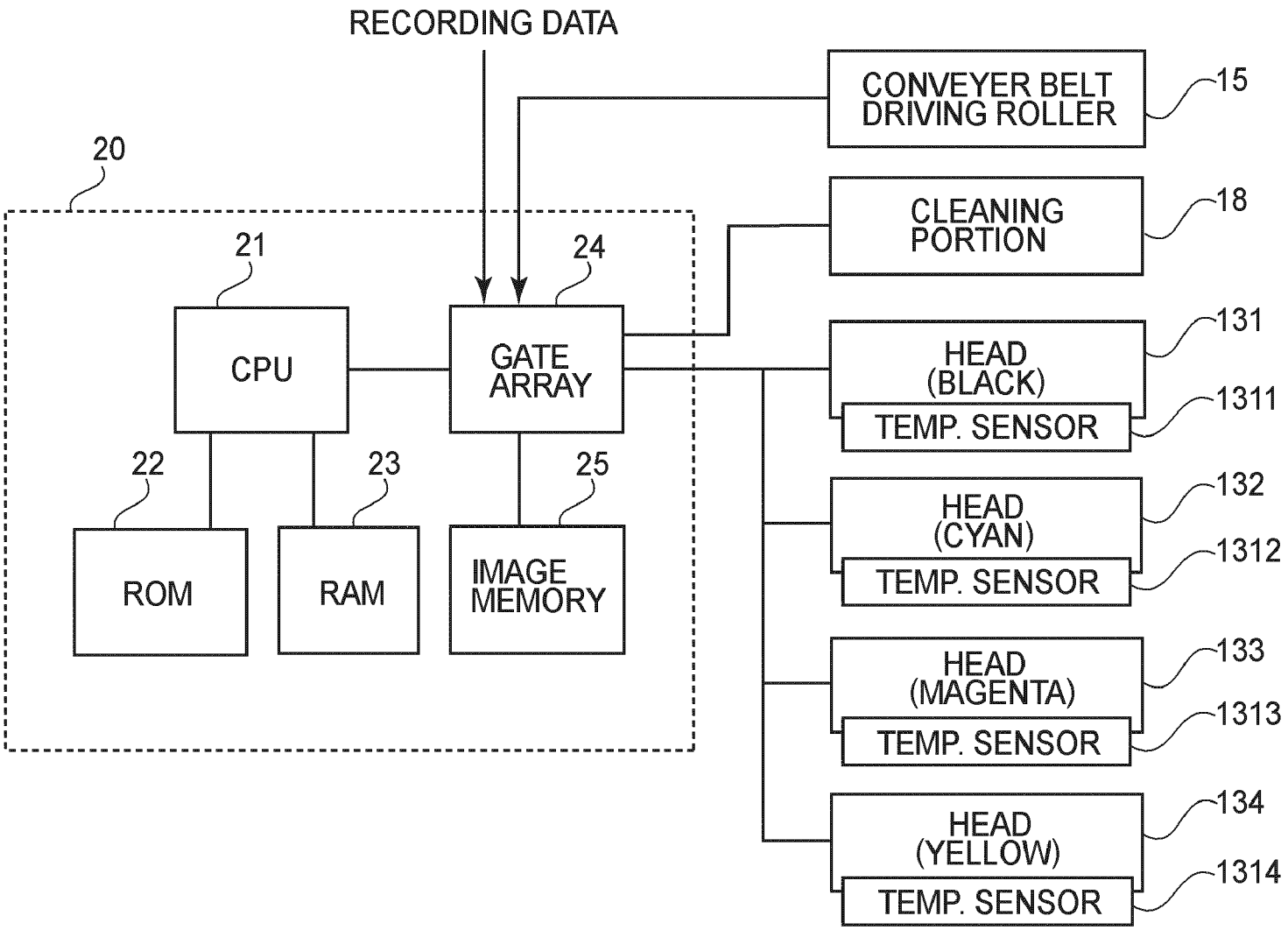
FIG. 2 is a block diagram showing a constitution of control of the ink jet recording head.

FIG. 2 is a block diagram showing a control constitution of the ink jet recording apparatus in this embodiment.

To the recording heads 131 to 134, temperature sensor units 1311 to 1314 for detecting temperatures of the recording heads are provided, respectively. Each of the temperature sensor units is disposed at both end portions of an associated recording element substrate with respect to a longitudinal direction of the recording element substrate.

A control portion (unit) 20 includes a CPU 21, a ROM 22, a RAM 23, a gate array 24, and an image memory 25. In the ROM 22, a program is stored. In the RAM 23, work data necessary for control is stored. The gate array 24 outputs a drive control signal for the conveyer belt driving roller 15, an image signal and a control signal which are to be sent to the recording head 13, a drive control signal for the cleaning mechanism 18, and the like. The image memory 25 temporarily stores recording data received from an external device by the gate array 24.

Figure 3:
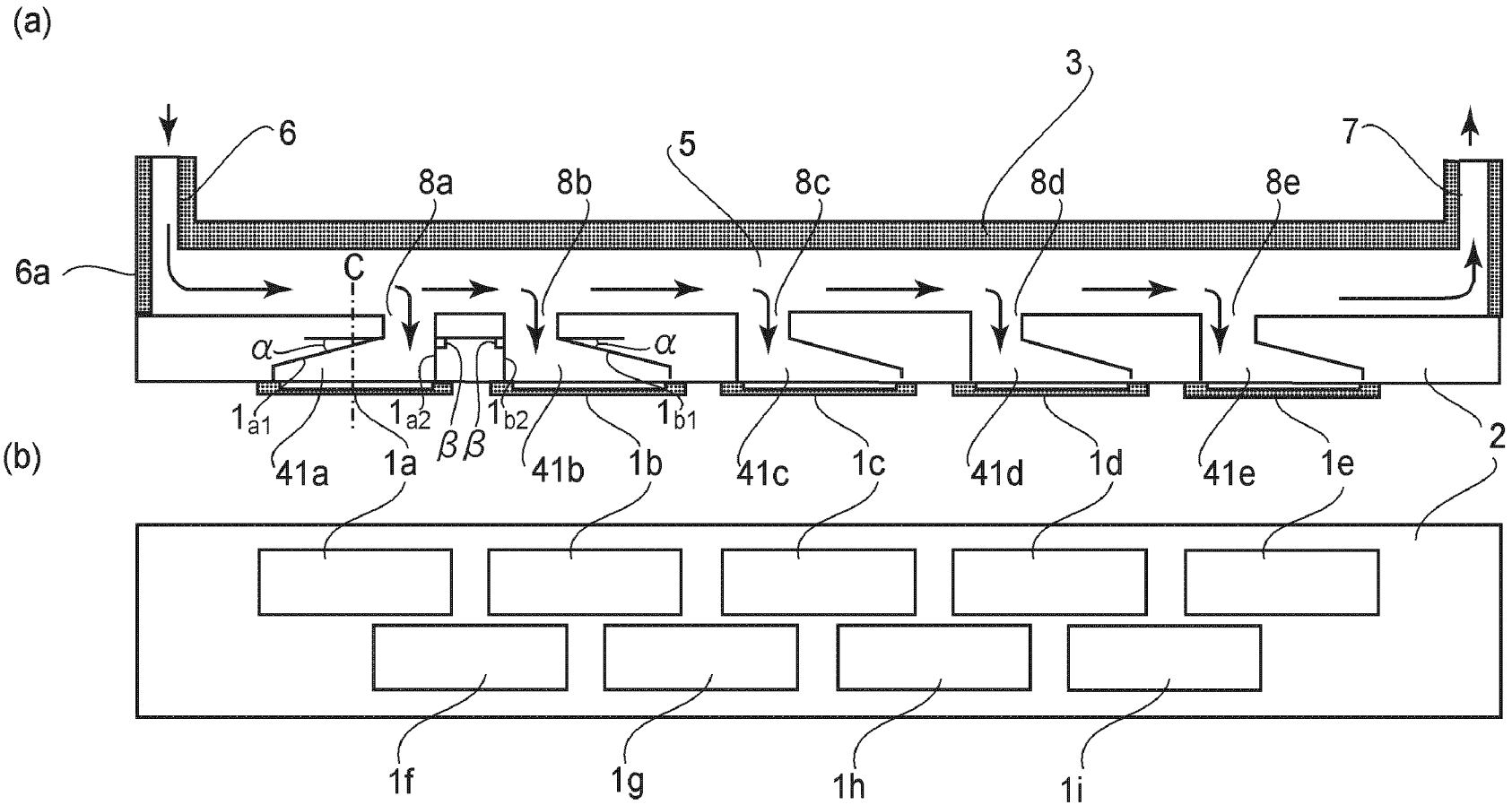
FIG. 3 includes a sectional view (a) and a bottom view (b) which show a schematic structure of an ink jet recording head in First Embodiment of the present invention.

FIG. 3 includes a sectional view (a) and a bottom view (b) which show a schematic structure of a full-line type ink jet recording head in this embodiment. A recording head shown in FIGS. 3(*a*) and 3(*b*) is identical to any of the recording heads 131 to 134 shown in FIGS. 1 and 2.

First, the schematic structure of the ink jet recording head in this embodiment will be described with reference to FIGS. 3(*a*) and 3(*b*).

Nine recording element substrates 1*a* to 1*i* each provided with a plurality of nozzle arrays (four nozzle arrays in this embodiment) are mounted on one side surface of a supporting member 2 in a staggered fashion. That is, these recording element substrates 1*a* to 1*i* are arranged in a flow direction of ink flowing in a common chamber 5 from an ink introducing port 6 toward a discharging port 7. In each of nozzles, a heat generating resistor for ejecting ink by heat energy is provided.

In the supporting member 2, individual liquid chambers 4 (41*a* to 41*e* in FIG. 3(*a*)) are formed for the recording element substrates 1*a* to 1*i*, respectively.

As a material for the supporting member 2, it is generally possible to use a ceramic material such as alumina (e.g., having a thermal conductivity of 32 W/mK). On an opposite side surface of the supporting member 2, ink inlet ports 8*a* to 8*e* for supplying ink to the individual liquid chambers 4 are formed for the recording element substrates, respectively. A container chip 3, in which the common liquid chamber 5 for retaining the ink in a negative pressure state is provided, is hermetically fixed to the supporting member 2 so as not to cause ink leakage.

Next, a supply route of the ink to each of the recording element substrates will be described. The ink introduced from the ink introducing port 6 into the recording head successively enters the ink inlet ports 8*a* to 8*e* while flowing in the common liquid chamber 5 in a longitudinal direction of the recording head. The ink successively entering the ink inlet ports 8*a* to 8*e* is supplied to odd-numbered nozzle arrays of the recording element substrates 1*a* to 1*e* through the individual liquid chambers 41*a* to 41*e*. The ink is similarly supplied to even-numbered nozzle arrays of the recording element substrates 1*a* to 1*e*.

Bubbles generated in the recording element substrates 1*a* to 1*e* are moved upward in ink supply passages in the individual liquid chambers 41*a* to 41*e* by buoyancy and pass through the ink inlet ports 8*a* to 8*e* to gather at an upper portion of the common liquid chamber 5. The bubbles gathering at the upper portion of the common liquid chamber 5 are discharged from the discharging port 7 for bubble removal together with the ink by circulation of the ink flowing from the ink introducing port 6 toward the discharging port 7 for bubble removal, thus being collected in an unshown ink container.

Next, a conveying process of the recording medium and a recording process on the recording medium will be described. Referring to the bottom view of FIG. 3(*b*), the recording medium is conveyed from an up-to-down direction in parallel with one side surface of the supporting member 2 in a direction perpendicular to an arrangement direction of the nozzle arrays of the recording element substrates 1*a* to 1*e* by a conveying means shown in FIG. 1. When the recording medium reaches a position immediately below the recording head, first, ink droplets are ejected from each of nozzle arrays of odd-numbered recording element substrates l*a* to l*e* to form dots on the recording medium by using the control constitution shown in FIG. 2. Then, ink droplets are ejected from each of nozzle arrays of even-numbered recording element substrates if to l*i* to form dots on the recording medium so as to complement intervals among the dots previously formed, thus completing an image for each raster.

Next, a conduction route of heat generated in the recording element substrate 1 (1*a* to 1*i*) by ejection of the ink droplets will be described. An amount of heat obtained by subtracting heat carried by the ejected ink and kinetic energy of the ejected ink from electric power supplied to the recording element substrate 1 for ejecting the ink droplets corresponds to an amount of heat generated in the recording element substrate 1. An amount of heat obtained by subtracting an amount of heat released from the recording element substrate 1 to the ambient air is conducted to the supporting member 2. In this case, a direct contact portion between the recording element substrate 1 and the supporting member 2 is a small frame portion which is an adhesive portion between the recording element substrate 1 and the supporting member 2, and heat is conducted through the ink in the individual liquid chamber 4. However, the ink has a poor thermal conductivity (0.68 W/mK), so that abrupt propagation of heat does not occur. As described above, a temperature of the ink flowing from the ink inlet ports 8*a* to 8*e* is gradually increased.

An upstreammost individual liquid chamber 41*a* with respect to the flow direction (of the ink flowing in the common liquid chamber 5 from the ink introducing port 6 toward the discharging port 7) has an asymmetrical cross-sectional configuration with respect to a center line c of the recording element substrate 1*a* with respect to the flow direction. That is, the ink inlet port 8*a* of the individual liquid chamber 41*a* is formed at a position apart from an end portion 6*a*, to which the ink introducing port 6 is provided, with respect to a longitudinal direction of the recording head. Therefore, in the individual liquid chamber 41*a*, a flow passage length from the ink inlet port 8*a* to a nozzle array closer to the end portion 6*a* of the recording element substrate 1*a* is longer than a flow passage length from the ink inlet port 8*a* to a nozzle array more distant from the end portion 6*a* of the recording element substrate 1*a*. In other words, the individual liquid chamber 41*a* has such a structure that an ink flow passage length from the ink inlet port 8*a* to a nozzle located upstream with respect to the flow direction is longer than an ink flow passage length from the ink inlet port 8*a* to a nozzle located downstream with respect to the flow direction.

Further, both side walls $\mathbf{1}_{a1}$ and $\mathbf{1}_{a2}$ of the individual liquid chamber 41*a* provide different inclination angles α and β. The inclination angles α and β are angles of the side walls with respect to a flow passage cross-section of the ink inlet port 8*a*. In this embodiment, the inclination angle β is 90 degrees and the inclination angle αis 90 degrees or less. Although not shown, an individual liquid chamber 41*f* for the recording element substrate 1*f*, of the even-numbered array of the recording element substrate 1*f* to 1*i*, closest to the ink introducing port 6, i.e., located upstreammost with respect to the flow direction, has a similar structure.

The individual liquid chamber 41*a* has the above-described structure, so that it is possible to considerably decrease a temperature difference with respect to the recording element substrate 1*a*.

That is, with respect to nozzles formed on the recording element substrate 1*a* at a position immediately below the ink inlet port 8*a*, the flow passage length from the ink inlet port 8*a* to the downstream nozzles is short, so that cool ink is supplied. On the other hand, with respect to opposite nozzles closer to the end portion 6*a*, the flow passage length from the ink inlet port 8*a* to the upstream nozzles is long, so that gradually warmed ink is supplied.

The individual liquid chambers 41*a* to 41*e* also have an asymmetric cross-sectional configuration with respect to a center line (not shown) of an associated recording element substrate (1*b*-1*e*) but are different from the individual liquid chamber 41*a* in that the ink inlet ports 8*b* to 8*e* are formed closer to the end portion 6*a*, i.e., upstream with respect to the flow direction. Therefore, in the individual liquid chambers 41*b* to 41*e*, the flow passage length from the ink inlet ports 8*b* to 8*e* to nozzle arrays closer to the end portion 6*a* for the recording element substrates 1*b* to 1*e* (upstream with respect to the flow direction) is shorter than the flow passage length from the ink inlet ports 8*b* to 8*e* to nozzle arrays more distant from the end portion 6*a* (downstream with respect to the flow direction).

Further, an inclination angle α of a side wall $\mathbf{1}_{b1}$ of the individual liquid chamber 41*b* and an inclination angle β of a side wall $\mathbf{1}_{b2}$ of the individual liquid chamber 41*b* are also different from each other. The inclination angle α is 90 degrees or less and the inclination angle β is 90 degrees. Although not shown, the individual liquid chambers 41*c* to 41*e* and individual liquid chambers 41*g* to 41*i* for the even-numbered array of the recording element substrates 1*f* to 1*i* also have a similar structure.

In the ink jet recording head of this embodiment, the individual liquid chamber 4*a* has the above-described structure, so that a temperature difference with respect to the recording element substrate 1*a* can be considerably decreased. Therefore, it is possible to considerably decrease a difference in temperature between both end portions of the ink jet recording head.

Figure 7:
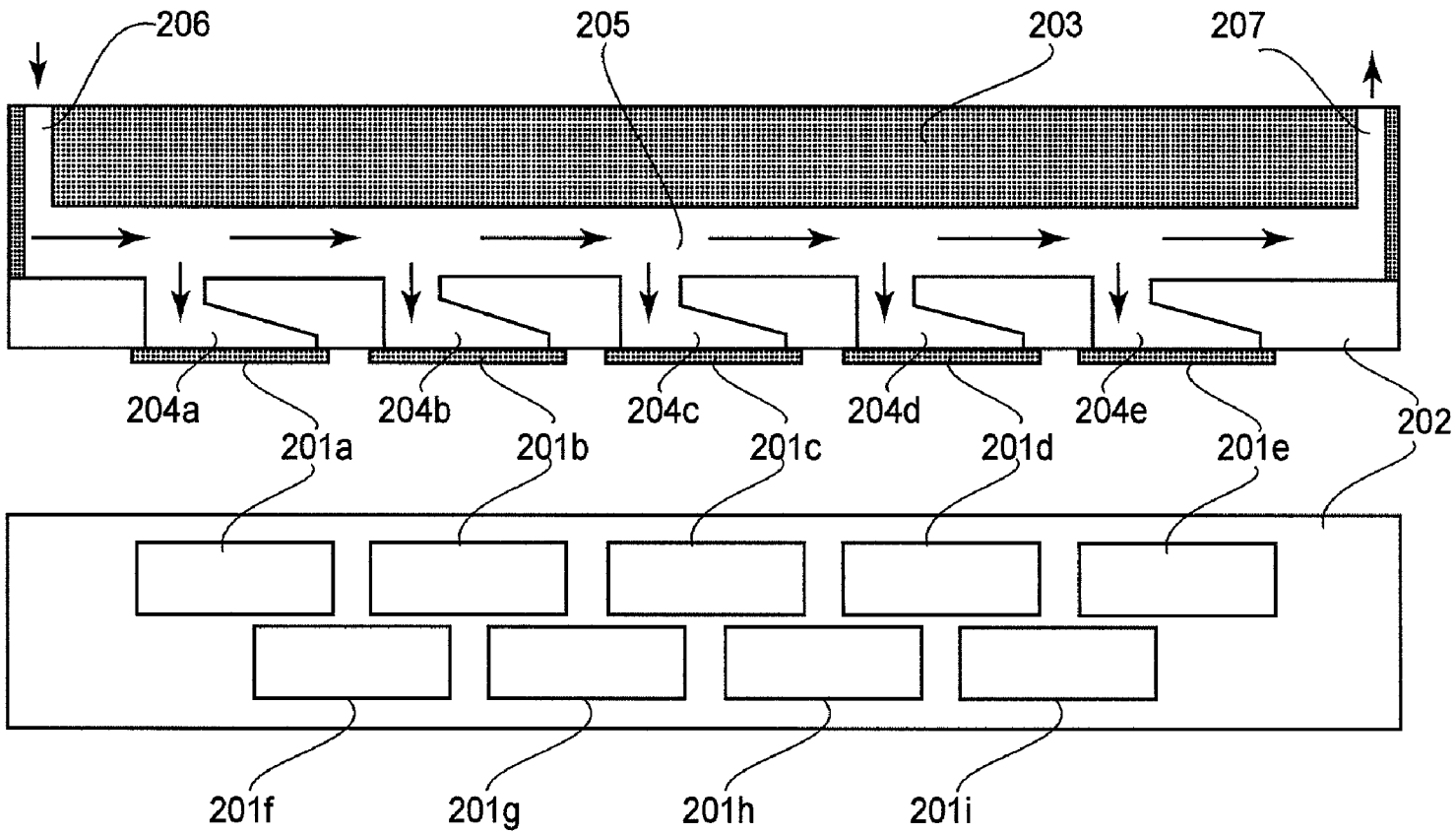
FIG.7 PRIOR ART
FIG. 7 includes a sectional view and a bottom view which show a schematic structure of a conventional ink jet recording head.
Figure 8:
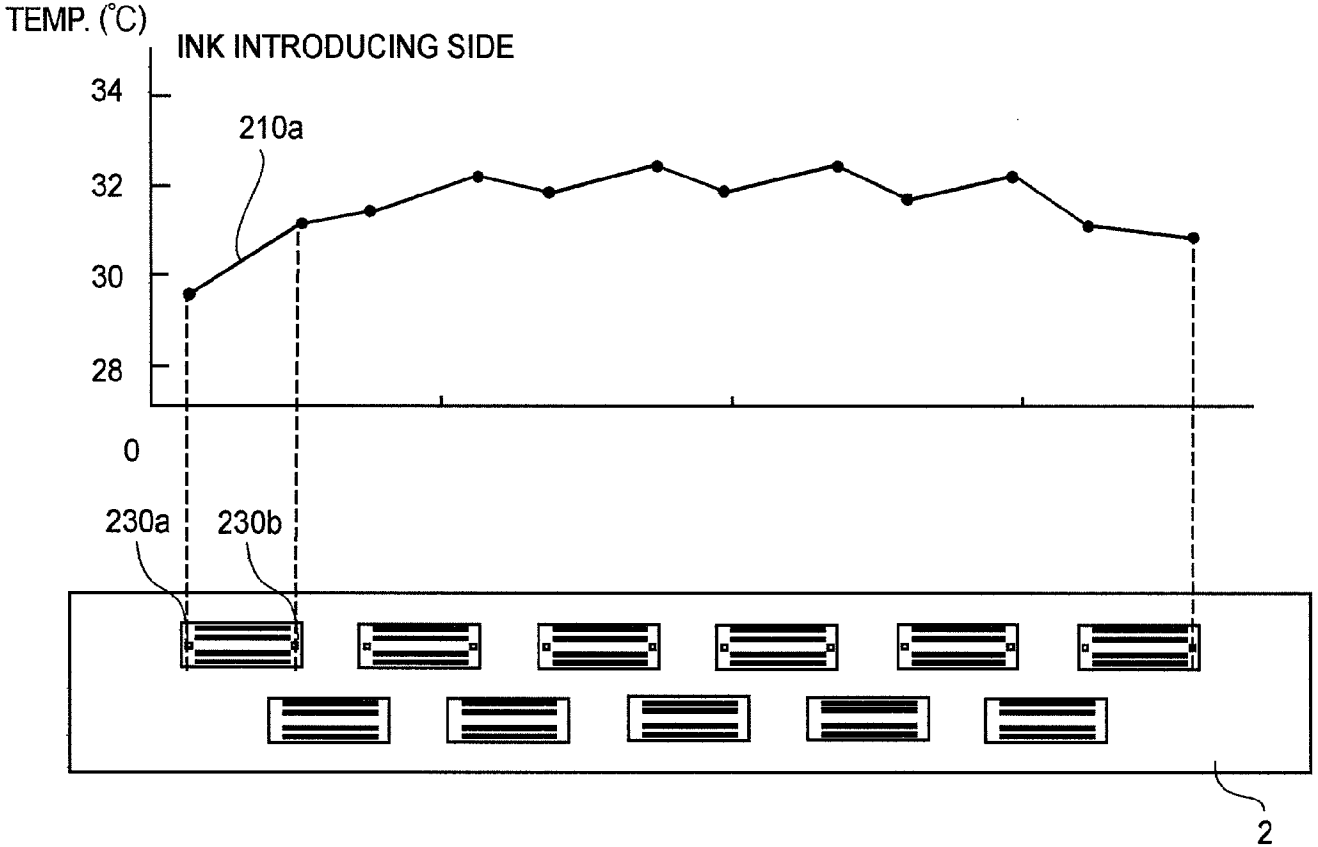
FIG.8 PRIOR ART
FIG. 8 is a graph showing a temperature distribution of respective recording element substrates in the conventional ink jet recording head.

In the case of the ink jet recording head having the individual liquid chamber 204*a* as shown in FIG. 7, a temperature on the ink introducing port 206 side (upstream side) is lowered, so that the difference in temperature between both end portions of the ink jet recording head is large as shown in FIG. 8. On the other hand, with respect to the recording element substrate 1*a* in this embodiment, the gradually warmed ink is supplied to the upstream side nozzle closer to the end portion 6*a*, so that a lowering in temperature of the recording element substrate 1*a* on the end portion 6*a* side is suppressed. As a result, the ink jet recording head of this embodiment can alleviate the temperature difference and density difference between the both end portions of the ink jet recording head without increasing in width thereof. Further, the ink jet recording head of this embodiment does not employ a heat pipe, so that production cost is not increased.

Second Embodiment

Figure 4:
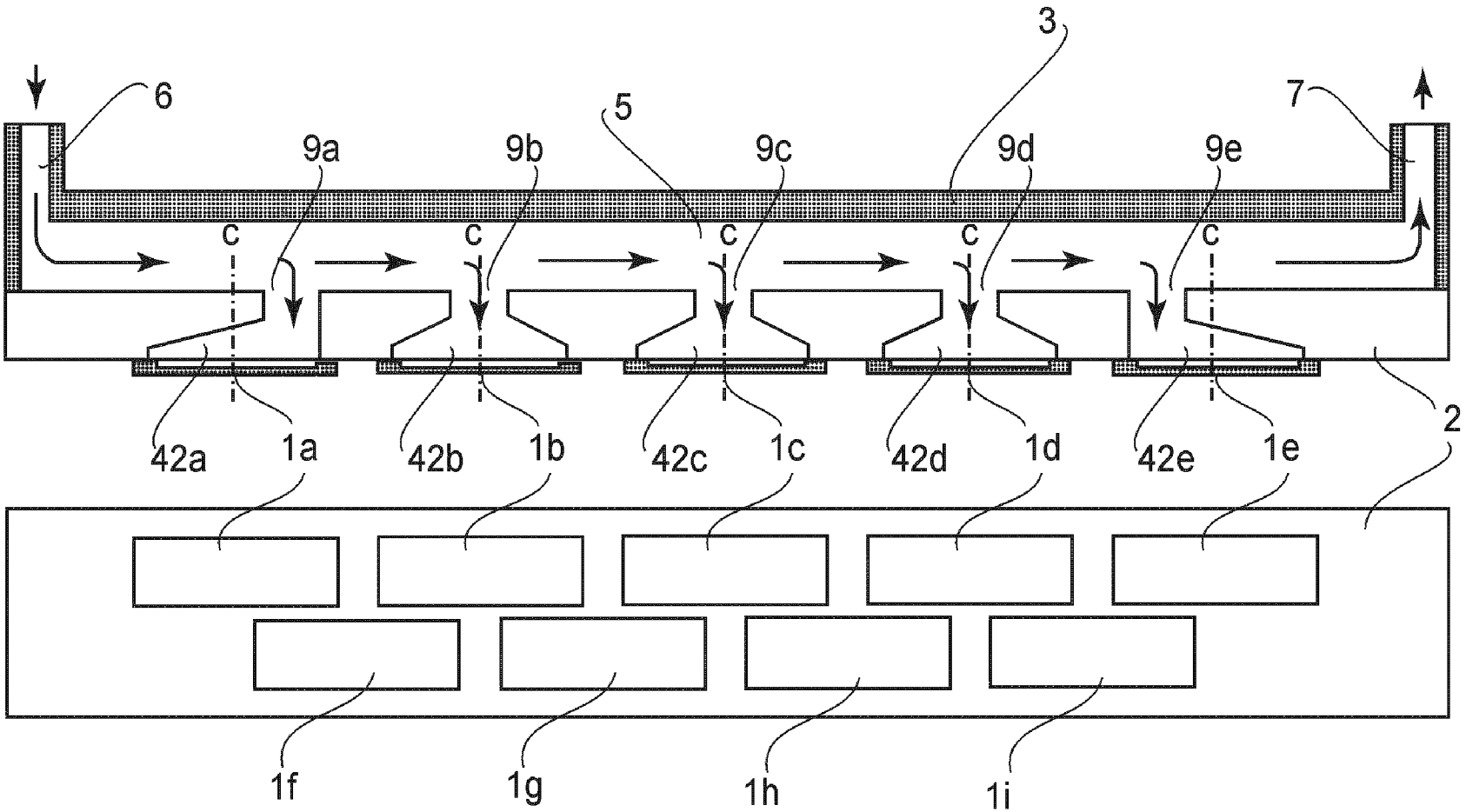
FIG. 4 includes a sectional view and a bottom view which show a schematic structure of an ink jet recording head in Second Embodiment of the present invention.

FIG. 4 illustrates a schematic structure of a full-line type ink jet recording head of this embodiment and includes a sectional view and a bottom view. A recording head in FIG. 4 is identical to any one of the recording heads 131 to 134 shown in FIG. 1 or FIG. 2. In the following, a constitution similar to that in First Embodiment will be omitted from description.

Referring to FIG. 4, individual liquid chambers 42*a* and 42*e* located at both end portions of the ink jet recording head of this embodiment, i.e., located upstreammost and downstreammost with respect to the flow direction, have an asymmetric configuration with respect to a center line C of an associated recording element substrate 1*a* or 1*e*.

On the other hand, individual liquid chambers 42*b*, 42*c* and 42*d* sandwiched between the individual liquid chambers 42*a* and 42*e* have a symmetrical configuration with respect to a center line C of an associated recording element substrate 1*b*, 1*c* or 1*d*. That is, ink inlet ports 9*b*, 9*c* and 9*d* are provided with the center line C as a center thereof and provided with both side walls having the same inclination angle.

Figure 5:
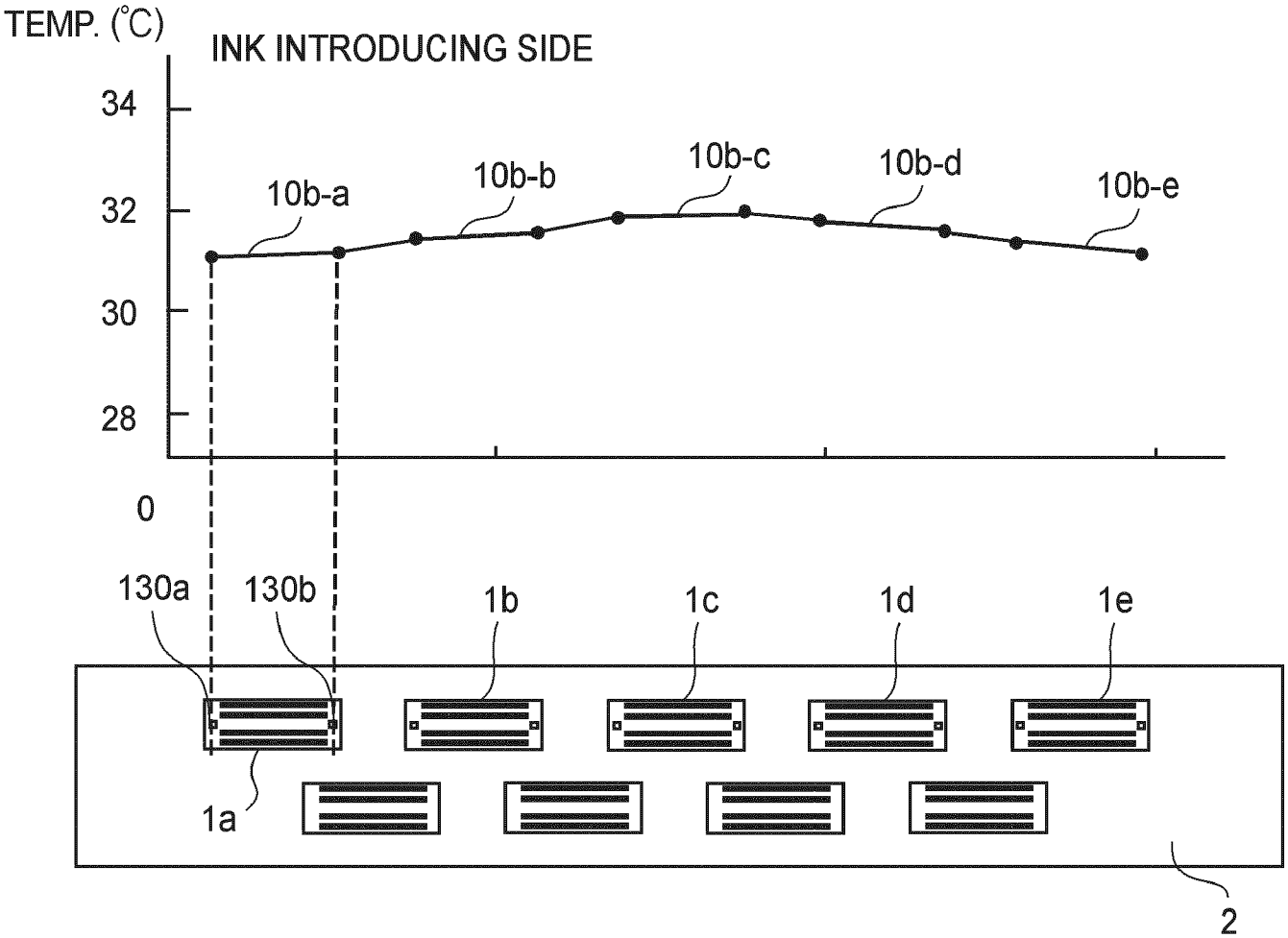
FIG. 5 is a graph showing a temperature distribution of respective recording element substrates in the ink jet recording head in Second Embodiment of the present invention.

A graph showing a temperature distribution in the case of using the ink jet recording head having such individual liquid chambers 42*a* to 42*e* is shown in FIG. 5.

In FIG. 5, an abscissa of the graph represents a distance corresponding to a position of the recording head with respect to a longitudinal direction of the recording head, and an ordinate of the graph represents temperatures of recording element substrates. At both end portions of each recording element substrate, temperature sensors 130*a* and 130*b* are provided so as to permit measurement of temperature at the both end portions. A plot of the temperatures from these temperature sensors is the graph shown in FIG. 5 and line segments 10*b*-*a* to 10*b*-*e* represent a temperature gradient of recording element substrates 1*a* to 1*e*, respectively.

The conventional ink jet recording head had, as shown in FIG. 8, a large temperature gradient for each of the recording element substrates. On the other hand, a temperature gradient of the recording element substrate 1*a* of the ink jet recording head in this embodiment is considerably improved as shown in FIG. 5. Similarly, also with respect to the temperature gradient of other recording element substrates 1*b* to 1*e*, a temperature difference between both ends of each recording element substrate is considerably improved.

Each of the individual liquid chambers 42*a* to 42*e* is formed in a configuration suitable for an associated recording element substrate correspondingly to a position of the associated recording element substrate.

In the individual liquid chambers 42*a* and 42*e*, the ink inlet ports 9*a* and 9*e* are formed at a position distant from an upstream end portion (for the ink inlet port 9*a*) or a downstream end portion (for the ink inlet port 9*e*) with respect to a longitudinal direction (ink flow direction) of the recording head. In the individual liquid chambers 42*b* to 42*d*, the ink inlet ports 9*b* to 9*d* are formed with the center line C of the associated recording element substrate (1*b* to 1*d*) as a center.

Third Embodiment

Figure 6:
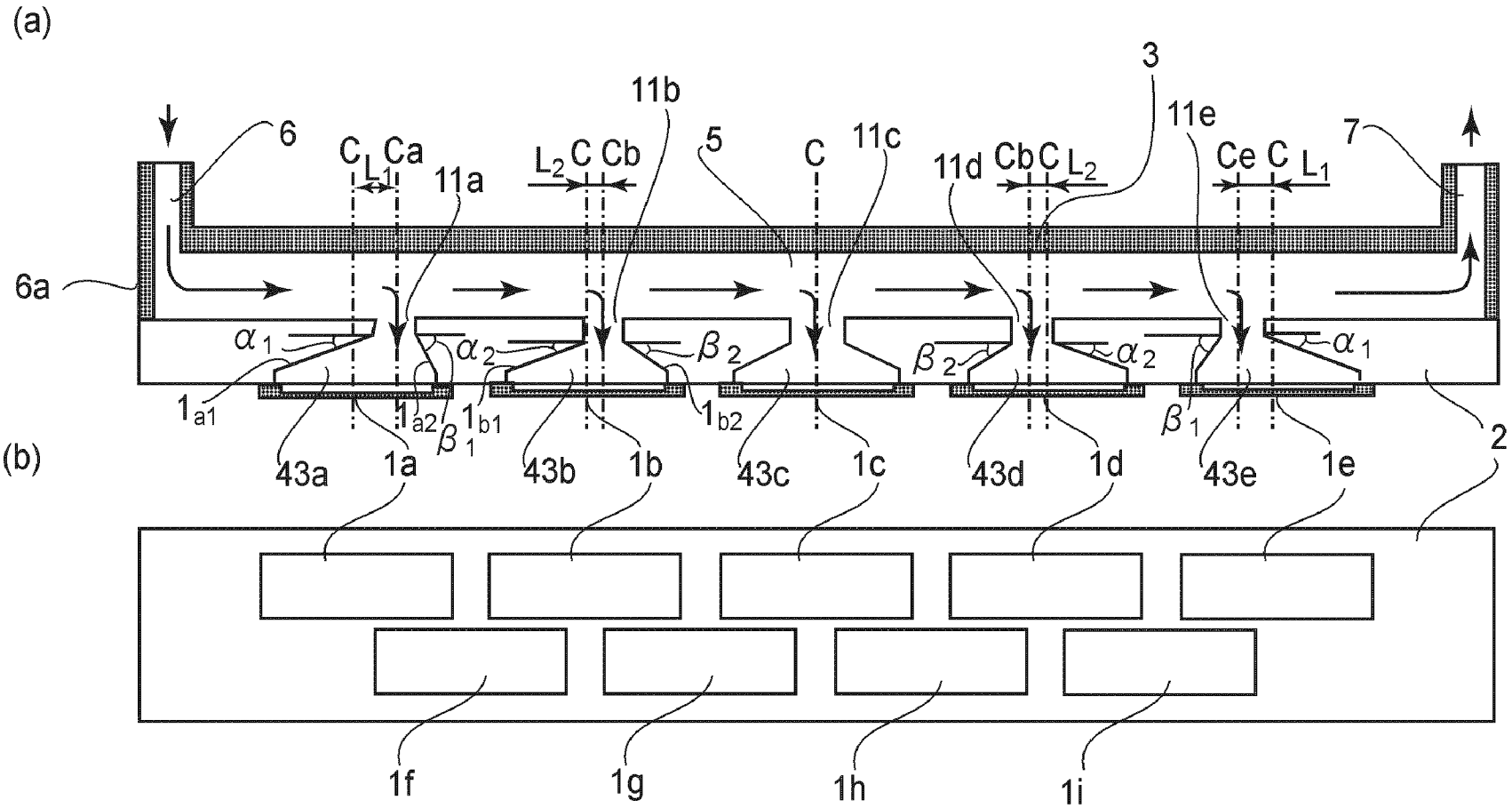
FIG. 6 includes a sectional view (a) and a bottom view (b) which show a schematic structure of an ink jet recording head in Third Embodiment of the present invention.

FIG. 6 illustrates a schematic structure of a full-line type ink jet recording head of this embodiment and includes a sectional view (FIG. 6(*a*)) and a bottom view (FIG. 6(*b*)). A recording head in FIG. 6 is identical to any one of the recording heads 131 to 134 shown in FIG. 1 or FIG. 2. In the following, a constitution similar to that in First Embodiment will be omitted from description.

In this embodiment, individual liquid chambers 43*a* to 43*e* have axially symmetrical configuration with respect to a center line C of the individual liquid chamber 43*c*. That is, the individual liquid chambers 43*a* and 43*e* are axially symmetrical and the individual liquid chambers 43*b* and 43*d* are axially symmetrical. For this reason, in the individual liquid chambers 43*a* to 43*e*, the ink flow passage from an associated ink inlet port to a nozzle located upstream with respect to the flow direction is equal to the ink flow passage from an associated ink inlet port to a nozzle located downstream with respect to the flow direction.

In the individual liquid chamber 43*a*, a center line Ca of the ink inlet port 11*a* is located distant from the end portion 6*a* and downstream of a center line C of the recording element substrate 1*a* by a distance $L_1$. Further, an inclination angle $\alpha_1$ of a side wall $\mathbf{1}_{a1}$ and an inclination angle $\beta_1$ of a side wall $\mathbf{1}_{a2}$ of the individual liquid chamber 43*a* are different from each other. In this embodiment, the inclination angles $\alpha_1$ and $\beta_1$ are 90 degrees or less but $\alpha_1<\beta_1$. That is, the inclination angle $\alpha_1$ on the upstream side closer to the end portion 6*a* is smaller than the inclination angle $\beta_1$ on the downstream side more distant from the end portion 6*a*, so that a length of the side wall $\mathbf{1}_{a1}$ is longer than a length of the side wall $\mathbf{1}_{a2}$. However, the length of the side wall $\mathbf{1}_{a1}$ in this embodiment is shorter than that in First Embodiment shown in FIG. 3 and the length of the side wall $\mathbf{1}_{a2}$ is longer than that in First Embodiment. Thus, the side wall $\mathbf{1}_{a1}$, the inclination angle $\alpha_1$, the side wall $\mathbf{1}_{a2}$, and the inclination angle $\beta_1$ of the individual liquid chamber 43*a* are optimized so as to minimize a temperature gradient of the recording element substrate 1*a*.

In the individual liquid chamber 43*b*, a center line Cb of the ink inlet port 11*a* is located distant from the end portion 6*a* and downstream of a center line C of the recording element substrate 1*b* by a distance $L_2$. Incidentally, $L_1>L_2$. Further, an inclination angle $\alpha_2$ of a side wall $\mathbf{1}_{b1}$ and an inclination angle $\beta_2$ of a side wall $\mathbf{1}_{b2}$ of the individual liquid chamber 43*b* are different from each other. In this embodiment, the inclination angles $\alpha_2$ and $\beta_2$ are 90 degrees or less but $\alpha_2<\beta_2$. When the individual liquid chamber 43*b* is compared with the upstream individual liquid chamber 43*a* closer to the end portion 6*a*, the inclination angles $\alpha_2$, $\beta_2$, $\alpha_l$ and $\beta_1$ satisfy $\alpha_1<\alpha_2$ and $\beta_1<\beta_2$. Further, the lengths of the side walls $\mathbf{1}_{b1}$, $\mathbf{1}_{b2}$, $\mathbf{1}_{a1}$ and $\mathbf{1}_{a2}$ satisfy $\mathbf{1}_{b1}<\mathbf{1}_{a1}$ and $\mathbf{1}_{b2<1a2}$. Thus, the side wall $\mathbf{1}_{b1}$, the inclination angle $\alpha_2$, the side wall $\mathbf{1}_{b2}$, and the inclination angle $\beta_2$ of the individual liquid chamber 43*a* are optimized so as to minimize a temperature gradient of the recording element substrate 1*b* more distant from the end portion 6*a* than the recording element substrate 1*a*.

Of the individual liquid chambers 43*a* to 43*e*, the center individual liquid chamber 43*c* has an axially symmetrical configuration with respect to the center line C thereof, which is also a center line of the ink jet recording head. For this reason, in the individual liquid chamber 43*c*, the flow passage length from the ink inlet port 11*c* to a nozzle located upstream with respect to the flow direction is equal to the flow passage length from the ink inlet port 11*c* to a nozzle located downstream with respect to the flow direction.

The individual liquid chamber 43*d* is, as described above, axially symmetrical with the individual liquid chamber 43*b* with respect to the center line C of the individual liquid chamber 43*c*, thus having a structure similar to that of the individual liquid chamber 43*b*.

The individual liquid chamber 43*e* is axially symmetrical with the individual liquid chamber 43*a* with respect to the center line C of the individual liquid chamber 43*c*, thus having a structure similar to that of the individual liquid chamber 43*a*.

As described above, the flow passage length from the ink inlet port (11*a* to 11*c*) to the nozzle located upstream with respect to the flow direction is gradually decreased from the upstreammost individual liquid chamber 43*a* toward the downstream individual liquid chamber 43*c* with respect to the flow direction.

On the other hand, the flow passage length from the ink inlet port (11*e* to 11*c*) to the nozzle located downstream with respect to the flow direction is gradually decreased from the downstream most individual liquid chamber 43*e* toward the upstream individual liquid chamber 43*c* with respect to the flow direction.

In this embodiment, as described above, in the individual liquid chambers 43*a* to 43*e*, positions of the ink inlet ports, magnitudes of the inclination angles and lengths of the side walls are set in view of positions of the recording element substrate 1*a* to 1*e* in order to minimize a temperature gradient with respect to the recording element substrate 1*a* to 1*e*.

In this embodiment, the constitution in which the individual liquid chambers 43*a*, 43*b*, 43*d* and 43*e* have symmetrical cross-sectional configuration with respect to the center line (of the recording head is described but the present invention is not limited thereto. That is, the individual liquid chambers are not required to be symmetrical so long as the temperature gradient with respect to each of the recording element substrates can be decreased.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 259901/2007 filed Oct. 3, 2007, which is hereby incorporated by reference.

What is claimed is:

1. An ink jet recording head comprising:

a plurality of recording element substrates, each including at least one nozzle array having a plurality of nozzles for ejecting ink and heat generating resistors for ejecting the ink by thermal energy;

a common liquid chamber having an ink introducing port for supplying the ink to the nozzles and a discharging port for discharging the introduced ink outside said ink jet recording head; and a supporting member on which said recording element substrates are mounted and in which a plurality of individual liquid chambers for supplying the ink to associated substrates of said recording element substrates and a plurality of ink inlet ports for supplying the ink from said common liquid chamber to associated chambers of the individual liquid chambers are formed, wherein the individual liquid chambers are arranged in a direction of flow of the ink flowing from the ink introducing port toward the discharging port, and wherein at least in a most upstream individual liquid chamber with respect to the ink flow direction, an ink flow passage length from an associated ink inlet port to a nozzle located upstream with respect to the ink flow direction is longer than an ink flow passage length from the associated ink inlet port to a nozzle located downstream with respect to the ink flow direction.

2. A head according to claim 1, wherein the ink flow passage length from the associated ink inlet port to the nozzle located upstream with respect to the ink flow direction is gradually decreased from the most upstream individual liquid chamber toward a downstream most individual liquid chamber with respect to the ink flow direction.

3. A head according to claim 1, wherein a most downstream individual liquid chamber with respect to the ink flow direction has such a structure that an ink flow passage length from an associated ink inlet port to a nozzle located downstream with respect to the ink flow direction is longer than an ink flow passage length from the associated ink inlet port to a nozzle located upstream with respect to the ink flow direction.

4. A head according to claim 1, wherein the ink flow passage length from the associated ink inlet port to the nozzle located downstream with respect to the ink flow direction is gradually decreased from a most downstream individual liquid chamber with respect to the ink flow direction toward the most upstream individual liquid chamber with respect to the ink flow direction.

5. A head according to claim 1, wherein the individual liquid chambers include an asymmetrical individual liquid chamber having an asymmetrical cross-sectional configuration with respect to a center line of an associated recording element substrate with respect to the ink flow direction, and wherein the asymmetrical individual liquid chamber has a first side wall inclined at a first angle of 90 degrees or less and a second side wall inclined at a second angle smaller than the first angle.

6. A head according to claim 1, wherein in a central individual liquid chamber with respect to the ink flow direction, an ink flow passage length from an associated ink inlet port to a nozzle located upstream with respect to the ink flow direction is equal to an ink flow passage length from the associated ink inlet port to a nozzle located downstream with respect to the ink flow direction.

7. An ink jet recording head comprising:

a plurality of recording element substrates, each including at least one nozzle array having a plurality of nozzles for ejecting ink and heat generating resistors for ejecting the ink by thermal energy;

a common liquid chamber having an introducing port for supplying the ink to the nozzles and a discharging port for discharging a bubble of the introduced ink outside said ink jet recording head; and a supporting member on which said recording element substrates are mounted and in which a plurality of individual liquid chambers for supplying the ink to associated substrates of said recording element substrates and a plurality of ink inlet ports for supplying the ink from said common liquid chamber to associated chambers of the individual liquid chambers are formed, wherein the individual liquid chambers are arranged in a direction of flow of the ink flowing from the ink introducing port toward the discharging port, and wherein at least in a most upstream individual liquid chamber with respect to the ink flow direction, a center line of an associated inlet port with respect to the ink flow direction is located downstream of a center line of the most upstream individual liquid chamber with respect to the ink flow direction.

* * * * *